US008149257B2

(12) United States Patent
Motoki et al.

(10) Patent No.: US 8,149,257 B2
(45) Date of Patent: Apr. 3, 2012

(54) PRINTER AND METHOD OF ADJUSTING CONVEYING DISTANCE OF RECORDING SHEET

(75) Inventors: Zenko Motoki, Fukushima-ken (JP); Minoru Sato, Fukushima-ken (JP); Hitoshi Funaki, Fukushima-ken (JP); Keigo Wakana, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 244 days.

(21) Appl. No.: 12/722,957

(22) Filed: Mar. 12, 2010

(65) Prior Publication Data

US 2010/0238256 A1 Sep. 23, 2010

(30) Foreign Application Priority Data

Mar. 17, 2009 (JP) ..... 2009-064119

(51) Int. Cl.
*B41J 13/00* (2006.01)
*B41J 11/00* (2006.01)

(52) U.S. Cl. ..... 347/218; 400/636

(58) Field of Classification Search ..... 347/215, 347/218; 400/578, 634, 636, 639
See application file for complete search history.

(56) References Cited

U.S. PATENT DOCUMENTS 7,439,994 B2 * 10/2008 Abe et al. ..... 347/215

FOREIGN PATENT DOCUMENTS

JP 2008-114415 5/2008

* cited by examiner

*Primary Examiner* — Huan Tran
(74) *Attorney, Agent, or Firm* — Hunton & Williams LLP

(57) ABSTRACT

A printer includes printing unit provided on a conveying path of a recording sheet and sheet feed unit provided on the downstream and upstream sides of the printing unit in a conveying direction of a recording sheet. The printer includes a platen roller, a first sheet feed roller, a second sheet feed roller, a first branch transmission gear group, a second branch transmission gear group, and thrust amount adjusting unit. A tooth trace of one of the gears of each of the first and second branch transmission gear groups has an inclination angle with respect to an axial direction, and the first and second branch transmission gear groups are formed of first and second idler gears including inclined gear portions of which inclined directions of tooth traces are the same as each other.

10 Claims, 2 Drawing Sheets

| | ADJUSTING SCREW |
|---|---|
| B DIRECTION | TIGHTEN → DECREASE OF THRUST |
| C DIRECTION | LOOSEN → INCREASE OF THRUST |

PRINTER AND METHOD OF ADJUSTING CONVEYING DISTANCE OF RECORDING SHEET

CROSS REFERENCE TO RELATED APPLICATION

The present invention contains subject matter related to and claims the benefit of Japanese Patent Application No. 2009-064119 filed in the Japanese Patent Office on Mar. 17, 2009, the entire contents of which is incorporated herein by reference.

BACKGROUND OF THE DISCLOSURE

1. Technical Field

The present invention relates to a printer that performs color printing by superimposing ink colors while reciprocating and conveying a recording sheet by sheet feed means provided on the downstream and upstream sides in a conveying direction of a recording sheet, and a method of adjusting the conveying distance of a recording sheet.

2. Related Art

A printer, which performs color printing by superimposing ink colors through thermal transfer while reciprocating and conveying a recording sheet, has been used in the past (see Japanese Unexamined Patent Application Publication No. 2008-114415). In general, the printer disclosed in Japanese Unexamined Patent Application Publication No. 2008-114415 includes first sheet feed means that is provided on the upstream side in a conveying direction of a recording sheet and second sheet feed means that is provided on the downstream side. The first and second sheet feed means includes first and second sheet feed rollers and first and second pressing rollers (not shown), respectively. The first and second sheet feed rollers can be rotationally driven. The first and second pressing rollers come into press contact with the first and second sheet feed rollers, respectively, and can be rotationally driven. A recording sheet is nipped between the first and second sheet feed rollers and the first and second pressing rollers of the respective sheet feed means, and is conveyed in the normal or reverse direction by the normal or reverse rotation of the sheet feed rollers.

Further, printing means for performing desired printing on a recording sheet is disposed between the first and second sheet feed means. The printing means includes a platen roller that may be rotationally driven by a driving force transmitted from a drive motor, and a thermal head that may come into contact with and be separated from the platen roller. Furthermore, an ink ribbon on which a plurality of ink layers is continuously formed is led between the thermal head and a recording sheet, the thermal head is moved down so that the ink ribbon and the recording sheet are nipped between the platen roller and the thermal head, and ink of the ink ribbon is thermally transferred to the recording sheet by selectively supplying current to heating elements of the thermal head.

Further, gears are mounted on the end portions of the platen roller and the sheet feed rollers, respectively (hereinafter, referred to as a platen gear, a first sheet feed gear, and a second sheet feed gear, respectively). Intermediate gears are provided at an intermediate position between the platen gear and the first sheet feed gear and at an intermediate position between the platen gear and the second sheet feed gear, respectively. Accordingly, a driving force, which is transmitted to the platen gear from the drive motor, is branched and transmitted to the respective sheet feed rollers, so that the respective sheet feed rollers are rotationally driven.

The intermediate gears are supported by gear support shafts, respectively. Each of the gear support shafts is disposed so as to adjust backlash between each of the intermediate gears and the sheet feed gears by changing the center distances between each of the intermediate gears and the sheet feed gears and so as to adjust timing where the driving force of the drive motor transmitted to the platen gear is transmitted to the respective sheet feed gears through the respective intermediate gears. That is, it may be possible to adjust timing where the respective sheet feed rollers start to be rotated after the start of the drive motor (hereinafter, referred to as start timing).

Meanwhile, since the printer disclosed in Japanese Unexamined Patent Application Publication No. 2008-114415 controls a conveying distance of a recording sheet by the number of steps of the drive motor, a difference between the conveying distance of a recording sheet that is conveyed in a conveying direction and the conveying distance of a recording sheet that is fed back in a reverse conveying direction has been generated by the reason such as the time lags of the start timing of the first and second sheet feed rollers. In this case, if images of ink colors are sequentially thermally transferred to a recording sheet while the recording sheet is reciprocated and conveyed, there is a problem in that printing failure such as positional deviation of the images of the respective ink colors, that is, so-called color deviation is generated in an image actually printed on the recording sheet.

Further, in the above-mentioned printer, the adjustment of the position of the gear support shaft of each of the intermediate gears, that is, the adjustment of a center distance between each intermediate gear and each sheet feed gear is performed by mounting a plurality of blocks, which has a pair of mounting holes formed to be separated from each other by a desired center distance, on the gear support shafts and the support shafts of the sheet feed rollers and the platen roller, respectively. In this adjustment, there are problems in that a plurality of blocks, which has a pair of mounting holes formed to be separated from each other by a predetermined center distance, needs to be previously produced and it is difficult to perform an adjusting operation. Furthermore, since the center distance between the respective gear support shafts is determined by the positions of the pair of mounting holes, it may not be possible to severely adjust the center distance. Moreover, as a result of the above-mentioned adjustment, if backlash between the first idler gear and the first sheet feed gear and backlash between the second idler gear and the second sheet feed gear are excessively small, so-called jitter has been generated on a printed image.

These and other drawbacks exist.

SUMMARY OF THE DISCLOSURE

Various embodiments provide a printer that can adjust a conveying distance of a recording sheet by a simple adjusting operation, prevent printing failure such as so-called color deviation by accurately conveying a recording sheet, and print an image with high quality.

According to these embodiments, a printer includes a platen roller, a first sheet feed roller, a second sheet feed roller, a first branch transmission gear group, a second branch transmission gear group, and thrust amount adjusting means. The platen roller is rotationally driven in normal and reverse directions by a driving force of a drive source, and includes a platen gear mounted at one end of a rotating shaft of the platen roller. The first sheet feed roller is provided on the upstream side of the platen roller in the conveying direction of the recording sheet so as to be rotationally driven in normal and reverse directions by a driving force of the drive source, and includes a first sheet feed gear mounted at one end of a rotating shaft of the first sheet feed roller. The second sheet feed roller is provided on the downstream side of the platen roller in the conveying direction of the recording sheet so as to be rotationally driven by a driving force of the drive source, and includes a second sheet feed gear mounted at one end of a rotating shaft of the second sheet feed roller. The first branch transmission gear group is provided on a power transmission path between the platen gear and the first sheet feed gear, and includes one or more gears transmitting the driving force of the drive source. The second branch transmission gear group is provided on a power transmission path between the platen gear and the second sheet feed gear, and includes one or more gears transmitting the driving force of the drive source. The thrust amount adjusting means adjust movable distances that are caused by the thrust of the first and second idler gears. A tooth trace of one of the gears of each of the first and second branch transmission gear groups has an inclination angle with respect to an axial direction, and the first and second branch transmission gear groups are formed of first and second idler gears including inclined gear portions of which inclined directions of tooth traces are the same as each other.

Further, in a printer according to various embodiments, the thrust amount adjusting means may be formed of first and second stopper members which are supported by a frame portion of the printer in the form of a cantilever and of which tips face the vicinities of the counter-thrust ends of the first and second idler gears. The movable distances, which are caused by the thrust of the first and second idler gears, may be adjusted by adjusting the protruding distances of the first and second stopper members from the frame portion.

Furthermore, according to an embodiment of the disclosure, a method of adjusting the conveying distance of a recording sheet includes thrustably providing one or more worm wheel gears, of which inclined directions of tooth traces are the same as each other, as gears of the first and second branch transmission gear groups; movably providing thrust amount adjusting means, which face the vicinities of the worm wheel gears on a counter-thrust side and regulate the movable distances of the worm wheel gear, in thrust directions of the worm wheel gears, respectively; and adjusting the start timing of the first and second sheet feed rollers by adjusting the positions of the thrust amount adjusting means in the thrust directions of the worm wheel gears and changing the thrust amounts of the worm wheel gears.

Moreover, in the method of adjusting the conveying distance of a recording sheet according to another aspect of the invention, the positions of the thrust amount adjusting means in the thrust directions of the worm wheel gears may be adjusted in consideration of time lags of start timing of the first and second sheet feed rollers.

Further, in the method of adjusting the conveying distance of a recording sheet according to another aspect of the invention, the time lags of the start timing of the first and second sheet feed rollers may be obtained by counting the number of steps until the start timing of the first and second sheet feed rollers from the drive start timing of a stepper motor as the drive source.

According to the various printer embodiments, since the start timing of the first and second sheet feed rollers is adjusted by adjusting the thrust amounts of the first and second sheet feed gears by the thrust amount adjusting means, it may be possible to accurately adjust the conveying distance of a recording sheet. Accordingly, in the printing of a color image by the reciprocation and conveyance of a recording sheet that are performed by the normal and reverse rotation of the first and second sheet feed rollers, it may be possible to prevent the occurrence of so-called color deviation that is caused by the deviation in the conveying distance of a recording sheet and to print an image with high quality. Further, since a conveying distance of a recording sheet is adjusted by the thrust amount adjusting means formed of the stopper members through the insertion of the adjusting screw portions that are inserted into the frame portion of the printer, it may be possible to adjust a conveying distance of a recording sheet by a simple adjusting operation. Furthermore, since it may be possible to perform an adjusting operation in a state of a completed product that is assembled with the frame portion of the printer body, adjustment does not need to be performed in a step of a partially-completed product unlike in the past and conveyance failure does not need to be detected again in a step of a completed product. Accordingly, it may be possible to obtain an advantage of improving productivity.

DESCRIPTION OF EXEMPLARY EMBODIMENTS

The following description is intended to convey a thorough understanding of the embodiments described by providing a number of specific embodiments and details involving printer and method of adjusting conveying distance of recording sheets. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

Figure 1A:
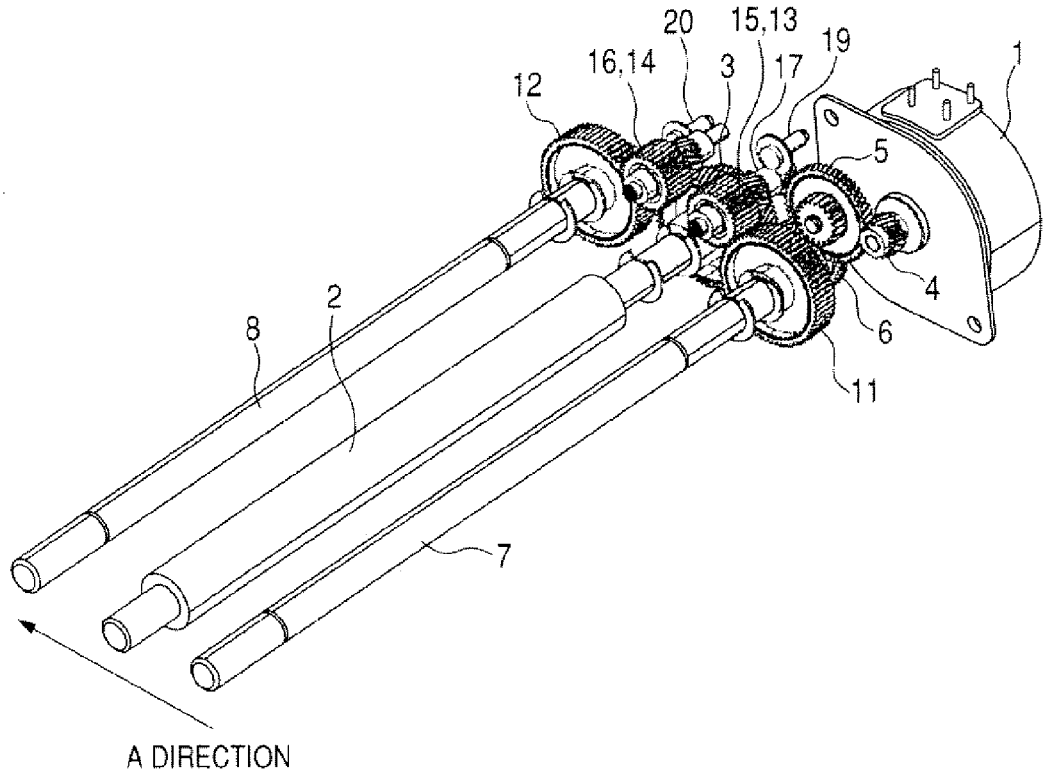
FIG. 1A is a perspective view of a printer according to an embodiment of the disclosure and FIG. 1B is an enlarged perspective view of an adjusting screw portion.
Figure 1B:
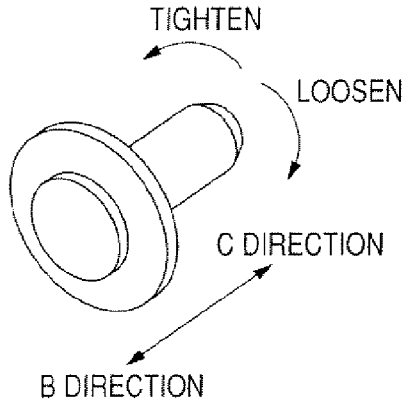
Figure 2:
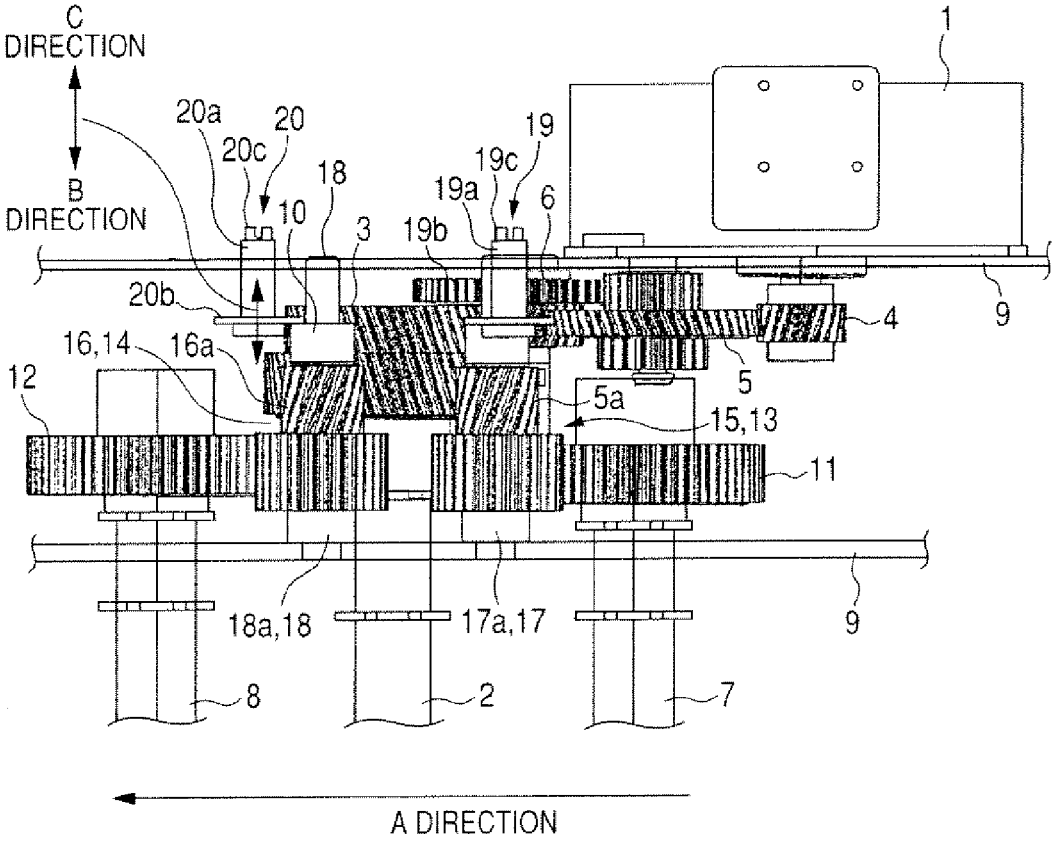
FIG. 2 is a plan view of FIG. 1.

A printer and a method of adjusting the conveying distance of a recording sheet according to various embodiments will be described below with reference to FIGS. 1 and 2. FIG. 1A is a perspective view of main parts of a printer according to an embodiment and FIG. 1B is an enlarged perspective view of an adjusting screw portion. Further, FIG. 2 is a plan view of FIG. 1.

A printer according to these embodiments can convey a recording sheet in a conveying direction (a direction of an arrow A in FIGS. 1A and 2) and a reverse conveying direction, and may include printing means that may be provided on a middle portion of a conveying path of a recording sheet.

The printing means may include a platen roller 2 and a thermal head (not shown). The platen roller may be orthogonal to the conveying direction of a recording sheet, and the thermal head can come into contact with and be separated from the platen roller 2 with a recording sheet and an ink ribbon interposed therebetween.

A platen gear 3, which may be a two-stage gear where a large-diameter gear and a small-diameter gear are concentrically disposed and integrated, may be mounted at one end of a rotating shaft of the platen roller 2. First and second intermediate gears 5 and 6, respectively, may be provided between the small-diameter gear and a shaft gear 4 mounted on a shaft of a drive motor 1 so that a driving force of the drive motor 1 may be sequentially transmitted to the shaft gear 4, the first intermediate gear 5, and the second intermediate gear 6.

Accordingly, the platen gear may be rotationally driven. Meanwhile, in these embodiments, the large-diameter gear of the platen gear 3 may be formed of a worm wheel gear.

Further, first sheet feed means and second sheet feed means may be provided on the downstream and upstream sides of the platen roller 2 in the conveying direction of a recording sheet. The first and second sheet feed means may include first and second sheet feed rollers 7 and 8 and first and second pressing rollers (not shown), respectively. The first and second sheet feed rollers 7 and 8 may be provided to be rotatable in the normal and reverse directions. The first and second pressing rollers (not shown) may be provided above the first and second sheet feed rollers 7 and 8 and can come into press contact with the first and second sheet feed rollers 7 and 8, respectively. First and second sheet feed gears 11 and 12 may be mounted at one ends of rotating shafts of the first and second sheet feed rollers 7 and 8, respectively. The first and second sheet feed gears 11 and 12 may be rotationally driven by driving forces of drive motor 1, which may be obtained by branching and transmitting the power of the drive motor 1 transmitted through first and second branch transmission gear groups 13 and 14. The first and second branch transmission gear groups may be provided on power transmission paths between the large-diameter gear of the platen gear 3 and the first and second sheet feed gears, respectively. The tooth trace of one of the gears of each of the first and second branch transmission gear groups 13 and 14 may have an inclination angle with respect to an axial direction, and the first and second branch transmission gear groups may be formed of first and second idler gears 15 and 16 including inclined gear portions of which the inclined directions of the tooth traces are the same as each other. Meanwhile, in these embodiments, the first branch transmission gear group 13 may be formed of only the first idler gear 15 and the second branch transmission gear group 14 may be formed of only the second idler gear 16, which will continue to be described below.

Here, each of the first and second idler gears 15 and 16 may be a two-stage gear where a large-diameter gear part and a small-diameter gear part are concentrically disposed and integrated, and worm wheel gears 15*a* and 16*a* as the inclined gear portions may be formed at the small-diameter gear parts. Further, the first and second idler gears 15 and 16 may be disposed so that the worm wheel gears 15*a* and 16*a* of the small-diameter gear parts are engaged with the large-diameter gear part of the platen gear 3 while the twist directions of the tooth traces of the worm wheel gears may be the same as each other and the large-diameter gear parts are engaged with the first and second sheet feed gears 11 and 12, respectively.

The first and second idler gears 15 and 16 may be supported by first and second support shafts 17 and 18, respectively. The first and second support shafts 17 and 18 may be fixed on one side of a printer body in the conveying direction of a recording sheet so as to be suspended between a pair of frame portions 9 that is disposed in the conveying direction so as face each other. Further, locking portions 17*a* and 18*a*, to which the first and second idler gears 15 and 16 are locked, respectively, may be formed at one ends (lower ends in FIG. 2) of the first and second support shafts 17 and 18. Further, bearings 10 are mounted at the other ends (upper ends in FIG. 2) of the first and second support shafts 17 and 18, respectively, so as to slide in the axial direction.

In these embodiments, first and second stopper members 19 and 20 as thrust amount adjusting means for adjusting the thrust amounts of the first and second idler gears 15 and 16 may be disposed near the first and second support shafts 17 and 18, respectively.

The first and second stopper members 19 and 20 may include columnar support portions 19*a* and 20*a* and disk-shaped contact portions 19*b* and 20*b* that may be fixed to the tip portions of the support portions 19*a* and 20*a*, respectively. The base end portions of the support portions 19*a* and 20*a* may be formed of first and second adjusting screw portions 19*c* and 20*c* on which threads are formed. Further, the support portions 19*a* and 20*a* may be fitted and inserted into screw holes that may be formed through the frame portion 9, the contact portions 19*b* and 20*b* may be disposed so as to come into contact with one sides (upper sides in FIG. 2) of the bearings 10 that are mounted on the first and second support shafts 17 and 18, and the contact portions 19*b* and 20*b* may be adjusted to appropriate positions by the adjustment of the insertion distances of the first and second adjusting screw portions 19*c* and 20*c*. Meanwhile, the first and second stopper members 19 and 20 are not limited to the above-mentioned structure.

Accordingly, in these embodiments, it may be possible to adjust the positions of the first and second contact portions 19*b* and 20*b* in a direction of an arrow B or C of FIG. 2 by adjusting the first and second adjusting screw portions 19*c* and 20*c*, and to adjust the thrust amounts of the first and second idler gears by regulating the thrustable distances of the first and second idler gears 15 and 16. As a result, it may be possible to adjust the timing where the driving forces transmitted to the platen roller 2 from the drive motor 1 are transmitted to the respective first and second idler gears 15 and 16, and to adjust the start timing of the first and second sheet feed rollers 7 and 8 from the start of the operation of the drive motor 1.

Specifically, in these embodiments, as shown in FIGS. 1A and 2, the twist direction of the tooth trace of the large-diameter gear part of the platen gear 3 is a left-handed direction, and the twist direction of the tooth trace of the small-diameter gear part of each of the first and second idler gears 15 and 16, which are engaged with the large-diameter gear part of the platen gear, may be a right-handed direction. Accordingly, in the adjustment of the thrust amount when the first and second sheet feed rollers 7 and 8 are rotated in a normal direction so as to convey a sheet in a normal direction, as shown in FIG. 1B, it may be possible to adjust thrust by loosening the first adjusting screw portion 19*c* for the increase of the thrust amount of the first idler gear 15 and tightening the first adjusting screw portion 19*c* for the decrease of the thrust amount of the first idler gear 15.

A method of adjusting the conveying distance of a recording sheet in a printer, which has the above-mentioned structure, will be described below.

First, start timing where the first and second sheet feed rollers 7 and 8 start to be rotated is actually measured from the start point of the operation of the drive motor 1. Specifically, the measurement may be performed by counting the number of driving steps of the drive motor 1 that are required until the first and second sheet feed rollers 7 and 8 start from the start point of the operation of the drive motor 1.

Time lags of the start timing of the first and second sheet feed rollers may be calculated from the start timing of the respective first and second sheet feed rollers 7 and 8.

The insertion distance of the first adjusting screw portion 19*c* or the second adjusting screw portion 20*c* may be adjusted in consideration of the time lags of the start timing of the respective first and second sheet feed rollers 7 and 8, so that the positions of the first and second stopper members 19 and 20 are adjusted.

For example, as a result of the above-mentioned measurement, it may be confirmed that the first sheet feed roller 7 starts at the tenth step from the start point of the operation of the drive motor 1 and the second sheet feed roller 8 starts at the fifth step from the start point of the operation of the drive motor. In this case, it may be possible to make the start timing of the second sheet feed roller 8 be the same as that of the first sheet feed roller 7 by delaying the start timing of the second sheet feed roller 8 by five steps. The insertion distances of the first and second adjusting screw portions 19*c* and 20*c*, which may be required to advance or delay the start timing of the first and second sheet feed rollers 7 and 8 by one step, may be converted on the basis of the result of the adjustment of the printer that has been previously performed. Further, the second adjusting screw portion 20*c* may be loosened and the thrust amount of the second sheet feed gear 12 may be increased so that the start timing of the second sheet feed roller 8 is delayed by five steps on the basis of the result of the conversion. Accordingly, it may be possible to make the start timing of the second sheet feed roller 8 be the same as that of the first sheet feed roller 7 by delaying the timing, where the driving force of the drive motor 1 transmitted to the platen gear 3 is transmitted to the second sheet feed gear 12, by five steps of the drive motor 1.

Meanwhile, instead of the delay of the start timing of the second sheet feed roller 8 by five steps, the start timing of the first sheet feed roller 7 may be advanced by five steps. Further, if the difference between the conveying distances of the first and second sheet feed rollers 7 and 8 is not necessarily removed by making the start timing of the second sheet feed roller 8 be the same as that of the first sheet feed roller 7, the start timing of the first and second sheet feed rollers may be adjusted so that the difference between the start timing of the first and second sheet feed rollers becomes the number of ideal steps.

Meanwhile, it may be possible to measure the difference in the start timing of the first and second sheet feed rollers by measuring the dimension of the color deviation of ink colors in an image actually printed on a recording sheet instead of measuring the difference in the start timing of the first and second sheet feed rollers 7 and 8 by the number of driving steps of the drive motor 1 as described above.

As described above, according to the printer and the method of adjusting the conveying distance of a recording sheet of this embodiment, it may be possible to adjust the start timing of the first and second sheet feed gears 11 and 12 and to adjust the thrust amounts of the first and second sheet feed gears 11 and 12 by a simple adjusting operation that adjusts the insertion distances of the first and second adjusting screw portions 19*c* and 20*c*.

Accordingly, it may be possible to prevent so-called color deviation that is caused by the deviation in the conveying distance while a recording sheet is reciprocated and conveyed by the first and second sheet feed rollers 7 and 8, and to print an image with high quality.

Further, according to the printer and the method of adjusting the conveying distance of a recording sheet of this embodiment, adjustment is performed by the first and second adjusting screw portions 19*c* and 20*c*. Accordingly, it may be possible to perform fine adjustment. As a result, it may be possible to remove printing failure such as color deviation more reliably.

Meanwhile, the invention is not limited to the above-mentioned embodiment and may have various modifications if necessary.

It should be understood by those skilled in the art that various modifications, combinations, sub-combinations and alterations may occur depending on design requirements and other factors insofar as they are within the scope of the appended claims of the equivalents thereof.

Accordingly, the embodiments of the present inventions are not to be limited in scope by the specific embodiments described herein. Further, although some of the embodiments of the present invention have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. A printer that includes printing means provided on a conveying path of a recording sheet and sheet feed means provided on the downstream and upstream sides of the printing means in a conveying direction of a recording sheet, and performs color printing by superimposing ink colors while reciprocating and conveying the recording sheet by the sheet feed means, the printer comprising:

a platen roller that is rotationally driven in normal and reverse directions by a driving force of a drive source, and includes a platen gear mounted at one end of a rotating shaft of the platen roller;

a first sheet feed roller that is provided on the upstream side of the platen roller in the conveying direction of the recording sheet so as to be rotationally driven in normal and reverse directions by a driving force of the drive source, and includes a first sheet feed gear mounted at one end of a rotating shaft of the first sheet feed roller;

a second sheet feed roller that is provided on the downstream side of the platen roller in the conveying direction of the recording sheet so as to be rotationally driven by a driving force of the drive source, and includes a second sheet feed gear mounted at one end of a rotating shaft of the second sheet feed roller;

a first branch transmission gear group that is provided on a power transmission path between the platen gear and the first sheet feed gear and includes one or more gears transmitting the driving force of the drive source;

a second branch transmission gear group that is provided on a power transmission path between the platen gear and the second sheet feed gear and includes one or more gears transmitting the driving force of the drive source; and thrust amount adjusting means for adjusting movable distances that are caused by the thrust of first and second idler gears, wherein a tooth trace of one of the gears of each of the first and second branch transmission gear groups has an inclination angle with respect to an axial direction, and the first and second branch transmission gear groups are formed of the first and second idler gears including inclined gear portions of which inclined directions of tooth traces are the same as each other.

2. The printer according to claim 1, wherein the thrust amount adjusting means are formed of first and second stopper members which are supported by a frame portion of the printer in the form of a cantilever and of which tips face the vicinities of the counter-thrust ends of the first and second idler gears, and the movable distances, which are caused by the thrust of the first and second idler gears, are adjusted by adjusting the protruding distances of the first and second stopper members from the frame portion.

3. A method of adjusting the conveying distance of a recording sheet in a printer including printing means that includes a platen roller and a thermal head, first sheet feed means that is provided on the upstream sides of the printing means in a conveying direction of a recording sheet and includes a first sheet feed roller and a first pressing roller that comes into contact with the first sheet feed roller and is driven, and second sheet feed means that is provided on the downstream sides of the printing means in the conveying direction of a recording sheet and includes a second sheet feed roller and a second pressing roller that comes into contact with the second sheet feed roller and is driven, the printer reciprocating and conveying a recording sheet by transmitting a driving force of a drive source that rotates the platen roller to a first sheet feed gear provided on a rotating shaft of the first sheet feed roller through a first branch transmission gear group and a platen gear provided on a rotating shaft of the platen roller, rotating the first sheet feed roller in normal and reverse directions, transmitting a driving force of a drive source to a second sheet feed gear provided on a rotating shaft of the second sheet feed roller through a second branch transmission gear group and the platen gear, and rotating the second sheet feed roller in normal and reverse directions, and the printer obtaining desired color recording by superimposing ink colors in the printing means, the method comprising:

thrustably providing one or more worm wheel gears, of which inclined directions of tooth traces are the same as each other, as gears of the first and second branch transmission gear groups, movably providing thrust amount adjusting means, which face the vicinities of the worm wheel gears on a counter-thrust side and regulate the movable distances of the worm wheel gear, in thrust directions of the worm wheel gears, respectively, and adjusting the start timing of the first and second sheet feed rollers by adjusting the positions of the thrust amount adjusting means in the thrust directions of the worm wheel gears and changing the thrust amounts of the worm wheel gears.

4. The method according to claim 3, wherein the positions of the thrust amount adjusting means in the thrust directions of the worm wheel gears are adjusted in consideration of time lags of start timing of the first and second sheet feed rollers.

5. The method according to claim 3, wherein the time lags of the start timing of the first and second sheet feed rollers are obtained by counting the number of steps until the start timing of the first and second sheet feed rollers from the drive start timing of a stepper motor as the drive source.

6. A printer that includes printing unit provided on a conveying path of a recording sheet and sheet feeder provided on the downstream and upstream sides of the printing unit in a conveying direction of a recording sheet, and performs color printing by superimposing ink colors while reciprocating and conveying the recording sheet by the sheet feeder, the printer comprising:

a platen roller that is rotationally driven in normal and reverse directions by a driving force of a drive source, and includes a platen gear mounted at one end of a rotating shaft of the platen roller;

a first sheet feed roller that is provided on the upstream side of the platen roller in the conveying direction of the recording sheet so as to be rotationally driven in normal and reverse directions by a driving force of the drive source, and includes a first sheet feed gear mounted at one end of a rotating shaft of the first sheet feed roller;

a second sheet feed roller that is provided on the downstream side of the platen roller in the conveying direction of the recording sheet so as to be rotationally driven by a driving force of the drive source, and includes a second sheet feed gear mounted at one end of a rotating shaft of the second sheet feed roller;

a first branch transmission gear group that is provided on a power transmission path between the platen gear and the first sheet feed gear and includes one or more gears transmitting the driving force of the drive source;

a second branch transmission gear group that is provided on a power transmission path between the platen gear and the second sheet feed gear and includes one or more gears transmitting the driving force of the drive source; and thrust amount adjuster that adjusts movable distances that are caused by the thrust of first and second idler gears, wherein a tooth trace of one of the gears of each of the first and second branch transmission gear groups has an inclination angle with respect to an axial direction, and the first and second branch transmission gear groups are formed of the first and second idler gears including inclined gear portions of which inclined directions of tooth traces are the same as each other.

7. The printer according to claim 6, wherein the thrust amount adjuster comprises first and second stopper members which are supported by a frame portion of the printer in the form of a cantilever and of which tips face the vicinities of the counter-thrust ends of the first and second idler gears, and the movable distances, which are caused by the thrust of the first and second idler gears, are adjusted by adjusting the protruding distances of the first and second stopper members from the frame portion.

8. A method of adjusting the conveying distance of a recording sheet in a printer including a printing unit that includes a platen roller and a thermal head, first sheet feeder that is provided on the upstream sides of the printing unit in a conveying direction of a recording sheet and includes a first sheet feed roller and a first pressing roller that comes into contact with the first sheet feed roller and is driven, and second sheet feeder that is provided on the downstream sides of the printing unit in the conveying direction of a recording sheet and includes a second sheet feed roller and a second pressing roller that comes into contact with the second sheet feed roller and is driven, the printer reciprocating and conveying a recording sheet by transmitting a driving force of a drive source that rotates the platen roller to a first sheet feed gear provided on a rotating shaft of the first sheet feed roller through a first branch transmission gear group and a platen gear provided on a rotating shaft of the platen roller, rotating the first sheet feed roller in normal and reverse directions, transmitting a driving force of a drive source to a second sheet feed gear provided on a rotating shaft of the second sheet feed roller through a second branch transmission gear group and the platen gear, and rotating the second sheet feed roller in normal and reverse directions, and the printer obtaining desired color recording by superimposing ink colors in the printing unit, the method comprising:

thrustably providing one or more worm wheel gears, of which inclined directions of tooth traces are the same as each other, as gears of the first and second branch transmission gear groups, movably providing a thrust amount adjuster, which face the vicinities of the worm wheel gears on a counter-thrust side and regulate the movable distances of the worm wheel gear, in thrust directions of the worm wheel gears, respectively, and adjusting the start timing of the first and second sheet feed rollers by adjusting the positions of the thrust amount adjusting means in the thrust directions of the worm wheel gears and changing the thrust amounts of the worm wheel gears.

9. The method according to claim 8, wherein the positions of the thrust amount adjuster in the thrust directions of the worm wheel gears are adjusted in consideration of time lags of start timing of the first and second sheet feed rollers.

10. The method according to claim 8, wherein the time lags of the start timing of the first and second sheet feed rollers are obtained by counting the number of steps until the start timing of the first and second sheet feed rollers from the drive start timing of a stepper motor as the drive source.

* * * * *